US006057749A

United States Patent [19]

Doneghue

[11] Patent Number: 6,057,749

[45] **Date of Patent: *May 2, 2000**

[54] STRUCTURE AND METHOD FOR CONNECTION OF AN ELECTRICAL COMPONENT TO AN ELECTROMAGNETIC RELAY

[75] Inventor: Jeffrey A. Doneghue, Lawrenceville, Ill.

[73] Assignee: Siemens Electromechanical Components, Inc., Peach Tree City, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 09/188,744

[22] Filed: Nov. 9, 1998

Related U.S. Application Data

[63] Continuation-in-part of application No. 08/942,995, Oct. 2, 1997, abandoned.

[51] Int. Cl.[7] ..... H01H 51/22

[52] U.S. Cl. ..... 335/83; 335/128

[58] Field of Search ..... 335/78–86, 124, 335/128, 202

[56] References Cited

U.S. PATENT DOCUMENTS

| | | | |
|---|---|---|---|
| 5,003,274 | 3/1991 | Chikira et al. | 335/83 |
| 5,291,166 | 3/1994 | Chikira | 335/78 |
| 5,748,061 | 5/1998 | Tsutsui et al. | 335/83 |

FOREIGN PATENT DOCUMENTS

| | | |
|---|---|---|
| 162 179 | 7/1905 | Germany . |
| 32 20 405 | 12/1983 | Germany . |
| 34 28 595 | 2/1986 | Germany . |
| 883 203 | 3/1958 | United Kingdom . |

*Primary Examiner*—Lincoln Donovan

[57] ABSTRACT

An electromagnetic relay and method of fabrication, in accordance with the present invention, include a base defining a bottom plane, a motor assembly mounted on the base, the motor assembly including a bobbin, a core with at least one winding about the core and an electrical component for electrically coupling to the at least one winding, the electrical component having leads configured to relieve stress in the at least one winding at coupling portions to the at least one winding. An armature is supported to be movable about a predetermined point for movement between two contact operating positions. At least one contact assembly for selectively providing one of an open and closed circuit is included. At least one terminal member is mounted on the base having a distal end for electrically connecting an end of the winding with a source of energy, and a proximal end is formed by at least one depending leg to define a slot for receiving at least one lead of the electrical component.

11 Claims, 10 Drawing Sheets

STRUCTURE AND METHOD FOR CONNECTION OF AN ELECTRICAL COMPONENT TO AN ELECTROMAGNETIC RELAY

RELATED APPLICATION DATA

This application is a continuation-in-part of application Ser. No. 08/942,995, filed on Oct. 2, 1997, now abandoned and incorporated herein by reference.

BACKGROUND

1. Technical Field

The present invention relates to electromagnetic relay assembly structure and methods and, more particularly, to structure and methods for the connection of electrical components to terminals of electromagnetic relays.

2. Description of the Related Art

Electromagnetic relays are known and widely used throughout the electronics industry. Electromagnetic relays generally include a bobbin, a coil wound thereon, a core, an armature, a movable contact and at least one stationary contact. These components are assembled to form an electromagnet block. The electromagnet block, together with the remaining components, are mounted on a base. The base also provides a receptacle for electrically connecting terminals from the contacts and electromagnet block to control and load circuits. A cover is typically placed over the relay, engageable with the base, to form a closed casing.

Unfortunately, working environments for many electromagnetic relays are not predisposed to supplying a steady, regulated power supply to the relay coil. For example, it is not uncommon for electrical components used in automobiles, factories, manufacturing plants and power plants to experience current and/or voltage spikes from their power supplies. Therefore, during the production and assembly of relays, it is common to install electrical components such as diodes and resistors to protect the electromagnet block from high current and voltage spikes. More specifically, these electrical components are connected across the relay coil terminals to protect the coil by diverting the current or voltage spikes through the component rather than the coil.

Also, other adverse conditions such as temperature differentials and vibration often cause movement between the several components of a relay, thereby altering the required tolerances and detracting from the relay's performance. Therefore, the individual components within the relay assembly must be securely fastened, since undesired movement may eventually result in failures of the relays and their related electric circuits.

Thus, to resolve long-standing problems associated with relays and their related electric circuits, a need exists for electromagnetic relays which provide structure and are assembled in such a fashion to withstand the adversities of harsh operating environments and unregulated power supplies. Structural enhancements associated with the coil terminals of the electromagnetic relay are provided herein which will provide a more reliable relay and also reduce the number of steps required during the assembly process, thereby saving time and money.

SUMMARY OF THE INVENTION

An electromagnetic relay, in accordance with the present invention, includes a base defining a bottom plane, a motor assembly mounted on the base, the motor assembly including a bobbin, a core with at least one winding about the core and an electrical component for electrically coupling to the at least one winding, the electrical component having leads configured to relieve stress in the at least one winding at coupling portions to the at least one winding. An armature is supported to be movable about a predetermined point for movement between two contact operating positions. At least one contact assembly for selectively providing one of an open and closed circuit is included. At least one terminal member is mounted on the base having a distal end for electrically connecting an end of the winding with a source of energy, and a proximal end is formed by at least one depending leg to define a slot for receiving at least one lead of the electrical component.

In alternate embodiments, the electrical component may include a diode and/or a resistor. The leads of the electrical component may be routed through a portion of the bobbin. The leads may each include an end portion extending beyond the base, the end portions being formed to be disposed substantially parallel to the bottom plane. The end portions may be formed to have ends turned inwardly toward each other. The at least one depending leg is preferably configured to be mechanically crimped to secure at least one lead of the electrical component within a portion of the slot. The at least one leg may include a notch in an inner surface for receiving a lead of the electrical component. The at least one leg may have a protrusion on an inner surface for receiving a lead of the electrical component.

A method of assembling an electromagnetic relay includes the steps of providing a base defining a bottom plane, forming leads of an electrical component to be received in a portion of a bobbin, connecting a first lead of the electrical component to a first end of a coil wire, winding the coil wire about the bobbin, connecting a second end of the coil wire to a second lead on the electrical component, forming the leads of the electrical component connected to the ends of the coil wire to relieve stress in the coil wire, providing an armature supported to be movable about a predetermined point for movement between two contact operating positions, at least one contact assembly for selectively providing one of an open and closed circuit and at least one terminal member mounted on the base having a distal end for electrically connecting one end of the coil wire with a source of energy, and a proximal end formed by at least one depending leg to define a slot for receiving at least one lead of the electrical component and placing a motor assembly onto the base, the motor assembly including the bobbin, the core with the coil wire about the core and the electrical component such that the leads of the electrical component are received in the slot.

In alternate methods, the step of crimping the at least one depending leg to secure and connect the electrical component to the terminal member in also included. The slot may include an inner surface, the inner surface including a notch for receiving a lead of the electrical component and the method may further include the step of securing the lead of the electrical component in the notch. The slot may include an inner surface, the inner surface including a protrusion for capturing a lead of the electrical component behind the protrusion within the slot, and the method may further include the step of securing the lead of the electrical component behind the protrusion. The step of forming the leads of the electrical component connected to the ends of the coil wire to relieve stress in the coil wire may include the step of forming the leads to be substantially parallel to the base. The step of forming the leads to be substantially parallel to the base may include the step of forming the leads to have end portions thereof turned substantially toward each other.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

FIGS. 1–4 illustrate embodiments of electromagnetic relays having coil terminal members configured and dimensioned in accordance with the present invention. As will be discussed in further detail below, the two embodiments advantageously allow the insertion of an electronic component and the crimping operation to be performed from various directions.

Figure 1:
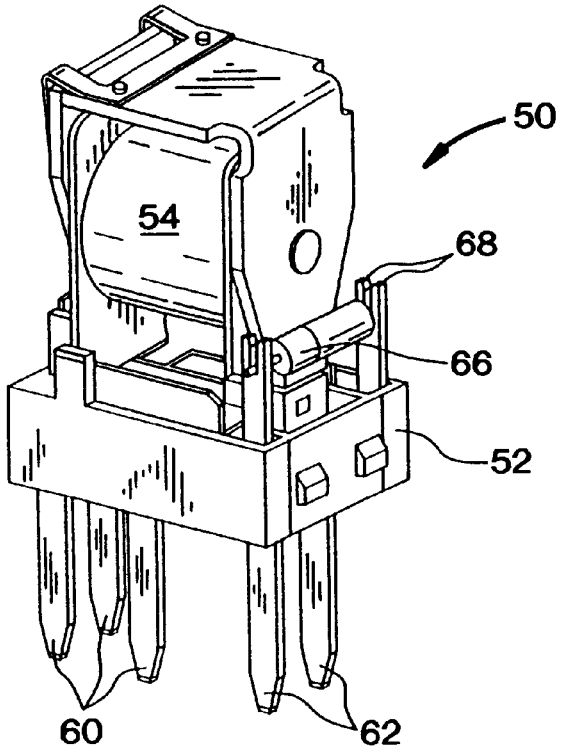
FIG. 1 is a perspective view illustrating an embodiment of an electromagnetic relay having coil terminals in accordance with the present invention.
Figure 2:
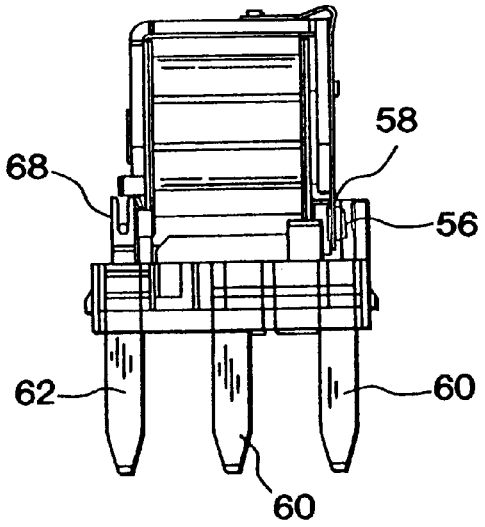
FIG. 2 is a side view of the relay of FIG. 1.

Referring initially to FIGS. 1 and 2, relay 50 comprises a base 52 which defines a main or bottom plane for the relay. An electromagnet assembly is mounted on base 52 and comprises a bobbin 54, a core, at least one winding about bobbin 54 and an armature. Stationary and movable contacts 56 and 58, respectively, are configured to selectively provide one of an open and closed circuit in response to energization signals received by the electromagnet assembly. That is, when the electromagnet assembly is energized, it causes movement of the armature which in turn moves movable contact 58 into or out of engagement with stationary contact 56.

A plurality of terminals are insertably received in the lower portion of base 52, to electrically connect the stationary and movable contacts and the electromagnet assembly with corresponding control and load circuits. Contact terminals are designated as numeral 60 and coil terminals are designated as numeral 62. Each of the terminals are typically inserted into slots in the base and are fixed by caulking, epoxy or by any other suitable sealant or method. The terminals extend substantially perpendicular from the linear plane of base 52.

As discussed above, the electromagnet assembly typically comprises a bobbin 54 having at least one coil winding thereon. The winding commences and ends with terminal ends which are electrically connected to a load circuit through terminals 62. To protect the coil from damage due to current and/or voltage spikes, an electrical component 66, such as a resistor or diode, is commonly connected across coil terminals 62. Conventional means for connecting electrical components 66 include welding or soldering.

In accordance with the present invention, terminals 62 include a pair of legs 68 extending from a proximal end which form a slot therebetween. Therefore, during assembly of the relay, an electrical component 66 may simply be connected to coil terminals 62 by inserting the leads of component 66 in the slot formed by legs 68. As will be discussed in further detail below, in accordance with the present invention, leads of component 66 may be secured between legs 68 by an interference fit or by mechanically crimping legs 68.

To accommodate varying manufacturing techniques and apparatus, the configuration and orientation of legs 68 may vary. As illustrated in FIGS. 1 and 2, legs 68 extend in a direction along the longitudinal axis of terminals 62 such that electrical component 66 may be placed in the slot formed by legs 68 from the top. This configuration will also provide access to legs 68 in the same direction for a crimping tool.

Figure 3:
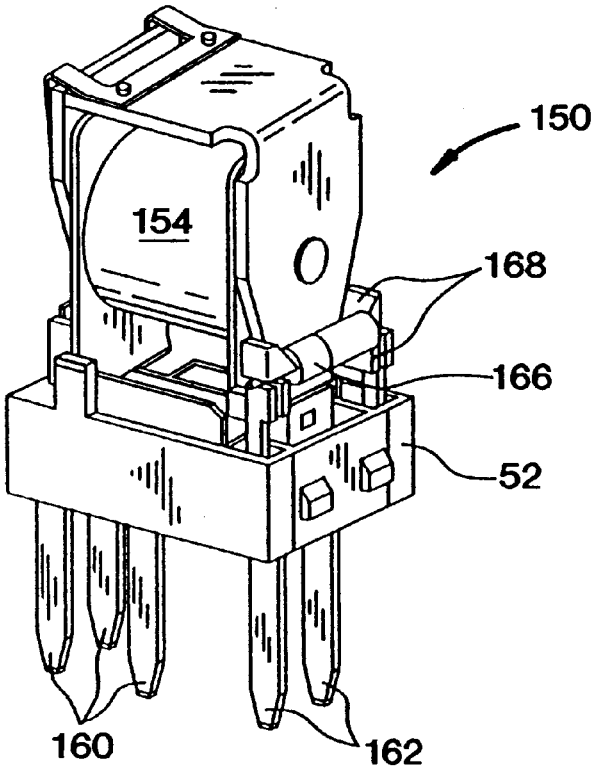
FIG. 3 is a perspective view illustrating another embodiment of an electromagnetic relay having coil terminals in accordance with the present invention.
Figure 4:
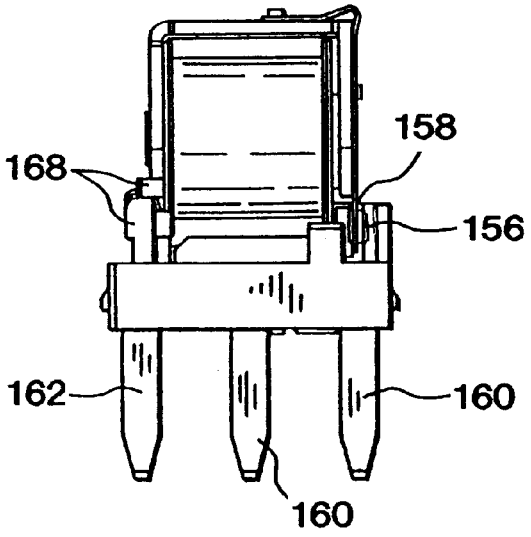
FIG. 4 is a side view of the relay of FIG. 3.

FIGS. 3 and 4 illustrate another embodiment of a relay having terminals configured in accordance with the present invention. Similar to relay 50 in FIGS. 1 and 2, electromagnetic relay 150 comprises a base 152 which defines a main or bottom plane for the relay. An electromagnet assembly is mounted on base 152 and comprises a bobbin 154, a core, at least one winding about bobbin 154 and an armature. Stationary and movable contacts 156 and 158, respectively, are configured to selectively provide one of an open and closed circuit in response to energization signals received by the electromagnet assembly. That is, when the electromagnet assembly is energized, it causes movement of the armature which in turn moves movable contact 158 into or out of engagement with stationary contact 156.

A plurality of terminals are insertably received in the lower portion of base 152, to electrically connect the stationary and movable contacts and the electromagnet assembly with corresponding control and load circuits. Contact terminals are designated as numeral 160 and coil terminals are designated as numeral 162. Each of the terminals are typically inserted into slots in the base and are fixed by caulking, epoxy or by any other suitable sealant or method. The terminals extend substantially perpendicular from the linear plane of base 152.

As discussed above, the electromagnet assembly typically comprises a bobbin 154 having at least one coil winding thereon. The winding commences and ends with terminal ends which are electrically connected to a load circuit through terminals 162. To protect the coil from damage due to current and/or voltage spikes, an electrical component 166, such as a resistor or diode, is commonly connected across coil terminals 162. Conventional means for connecting electrical components 166 include welding or soldering.

In accordance with the present invention, terminals 162 include a pair of legs 168 extending from a proximal end which form a slot therebetween. Therefore, during assembly of the relay, an electrical component 166 may simply be connected to coil terminals 162 by inserting the leads of component 166 in the slot formed by legs 168. As will be discussed in further detail below, in accordance with the present invention, leads of component 166 may be secured between legs 168 by an interference fit or by mechanically crimping legs 168.

In contrast with terminals 62 of relay 50 illustrated in FIGS. 1 and 2, terminals 162 of relay 150 are illustrative of an alternative embodiment wherein legs 168 extend in a direction which is substantially perpendicular to the longitudinal axis of terminals 162 such that electrical component 166 may be placed in the slot formed by legs 168 from the side.

Figure 5:
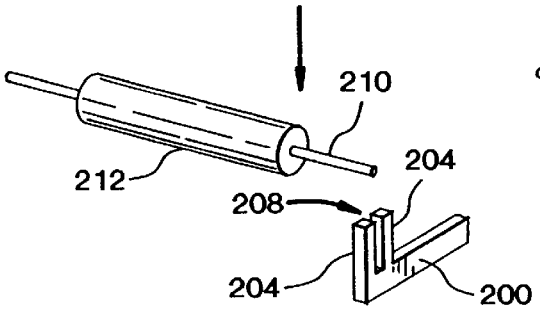
FIGS. 5 and 6 are perspective views illustrating two directions for inserting an electrical component in a coil terminal.
Figure 6:
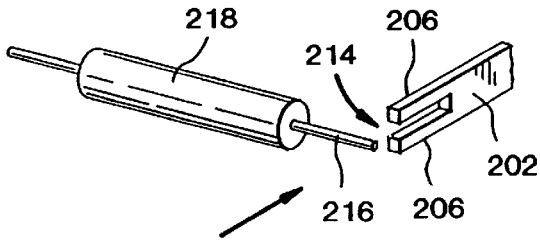

Referring now to FIGS. 5 and 6, the exploded detail views of terminals 200 and 202 illustrate alternative embodiments of legs 204 and 206 extending therefrom. Terminal 200 is configured such that a vertical slot 208 is formed by legs 204, to accept a lead 210 of an electrical component 212 which is moved in a direction which is substantially perpendicular to the longitudinal axis of the terminal, as indicated by the arrow. In an alternative embodiment, terminal 202 is configured such that a substantially horizontal slot 214 is formed by legs 216 extending therefrom, to accept a lead 216 of an electrical component 218 which is moved in a substantially horizontal direction along the longitudinal axis of the terminal, as indicated by the arrow. Thus, the embodiments of the terminals will accommodate varying manufacturing processes and apparatus.

Figure 7:
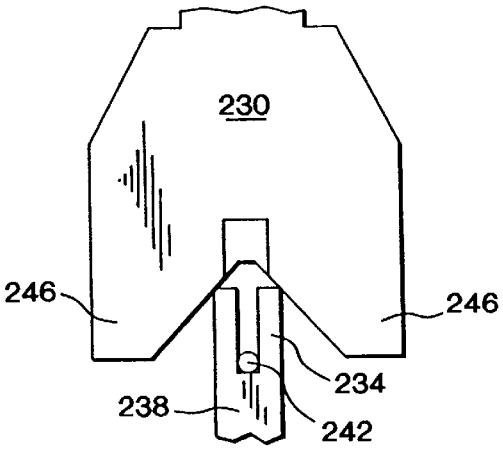
FIGS. 7 and 8 are partial side views illustrating the engagement of a crimping tool with a coil terminal.
Figure 8:
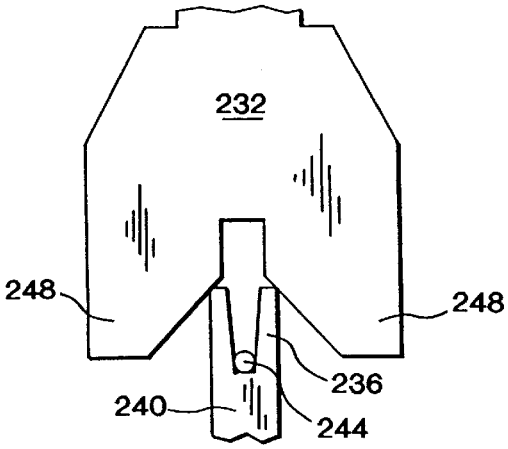

FIGS. 7 and 8 illustrate alternative embodiments of crimping tools 230 and 232 which may be utilized to crimp legs 234 and 236 extending from terminals 238 and 240 to secure leads 242 and 244 of an electrical component. Legs 246 and 248 extend from crimping tool 230 and 232, respectively, and are configured to receive terminal legs 234 and 236 therebetween such that a force exerted by the crimping tool against the terminal legs will cause the terminal legs to move toward each other. Thus, the configuration of the terminal legs and crimp tool facilitate crimping of the terminal legs by a simple motion. Advantageously, a crimp tool which requires a hinge motion is not required.

Figure 9:
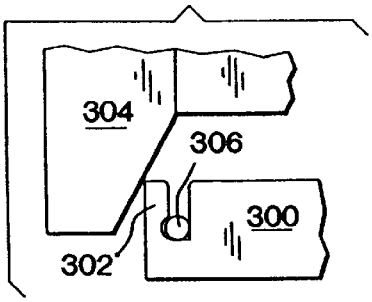
FIGS. 9–26 are partial side views of various embodiments of terminals configured to receive a lead of an electrical component.
Figure 10:
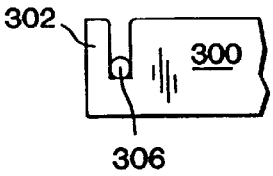
Figure 11:
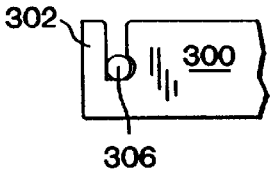
Figure 12:
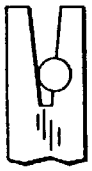
Figure 13:
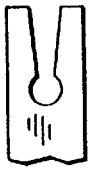
Figure 14:
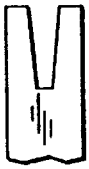
Figure 15:
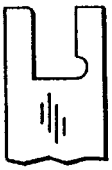

A plurality of configurations of terminal legs are contemplated, as illustrated in FIGS. 9–26. For example, a vertical slot may be formed by a single leg 302 adjacent an end of a horizontal terminal member 300 as illustrated in FIGS. 9–11. A crimp tool having one leg 304 extending therefrom may be used to engage the single terminal leg 302 and force it against the terminal body portion to secure a lead 306 of an electrical component.

FIGS. 12–26 illustrate legs extending from terminals in the substantially vertical or horizontal direction to receive an electrical component lead from a corresponding vertical or horizontal direction as discussed above with reference to FIGS. 5 and 6.

Also, FIGS. 12–26 illustrate additional features associated with the terminal legs, in accordance with the present invention, which are designed to enhance the ability of the legs to secure a lead of an electrical component. For example, the terminal legs in FIGS. 12–14 and 25, feature a tapered cross-sectional area of the slot formed by the legs. Therefore, as a lead is pressed into the slot it will experience an interference fit at a point within the slot wherein the cross-sectional area is less than the cross-sectional area of the lead. FIG. 18 illustrates a modified version of the configuration of FIGS. 12–14 and 25 wherein only a portion of one leg is tapered to provide an interference fit with a lead of an electrical component. Also, instead of a gradual taper, FIG. 20 illustrates a step in the cross-sectional area of the slot to provide an interference fit for the lead.

FIGS. 9, 11–13, 15 and 22–25 each illustrate a relief notch disposed in the inner surface of one or both of the terminal legs. During assembly, the lead of the electrical component will experience interference as it enters the slot between the terminal legs. However, as the lead enters the area defined by the relief notch, it will drop into the notch and the resiliency of the terminal legs will hold the lead in a position within the notch. The terminal legs may then be crimped to further secure the lead.

Figure 16:
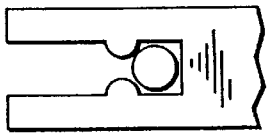
Figure 17:
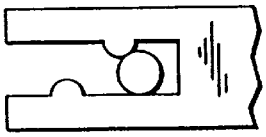
Figure 18:
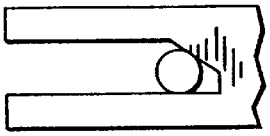
Figure 19:
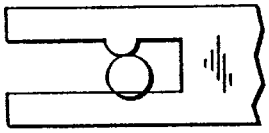
Figure 20:
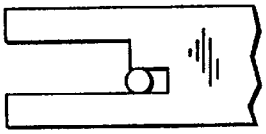
Figure 21:
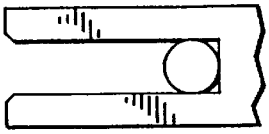
Figure 22:
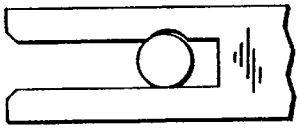
Figure 23:
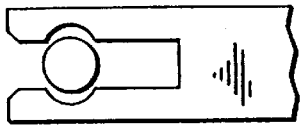
Figure 24:
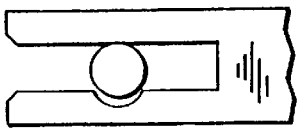
Figure 25:
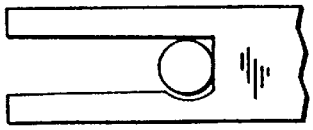

In other embodiments, FIGS. 16, 17 and 19 illustrate terminal legs having at least one ridge on the inner surface to provide an interference fit for the lead as it is inserted into the slot formed between the legs. A single ridge may be utilized as illustrated in FIG. 19, or at least two ridges may be utilized in varying configurations as illustrated in FIGS. 16 and 17.

Figure 26:
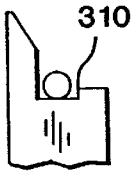

The embodiment of the terminal illustrated in FIG. 26 is similar to the embodiments of FIGS. 9–11 in that the lead is held within a slot by crimping one leg portion. A sharp corner 310 formed on a side of the slot opposite the one leg advantageously helps to retain the lead within the slot during the crimping operation.

Figure 27A:
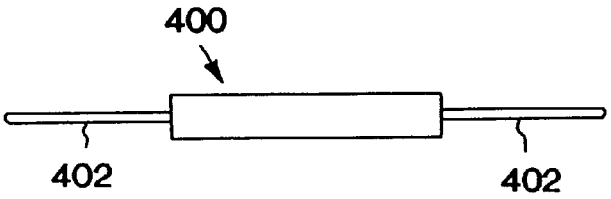
FIG. 27A is a top plan view of an electrical component having leads extending therefrom.
Figure 27B:
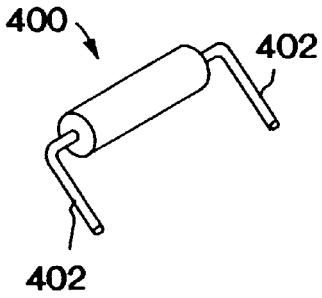
FIG. 27B is a perspective view of the electrical component of FIG. 27A after being formed in accordance with the present invention.
Figure 27C:
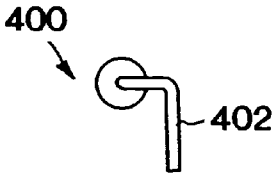
FIG. 27C is a side view of the electrical component of FIG. 27B after being formed a second time in accordance with the present invention.

Referring to FIGS. 27 A–C, an electrical component 400 such as a resistor or a diode is shown having leads 402 formed in a predetermined orientation. In one embodiment, leads 402 are formed as shown in FIG. 27B and then again as shown in FIG. 27C.

Figure 28:
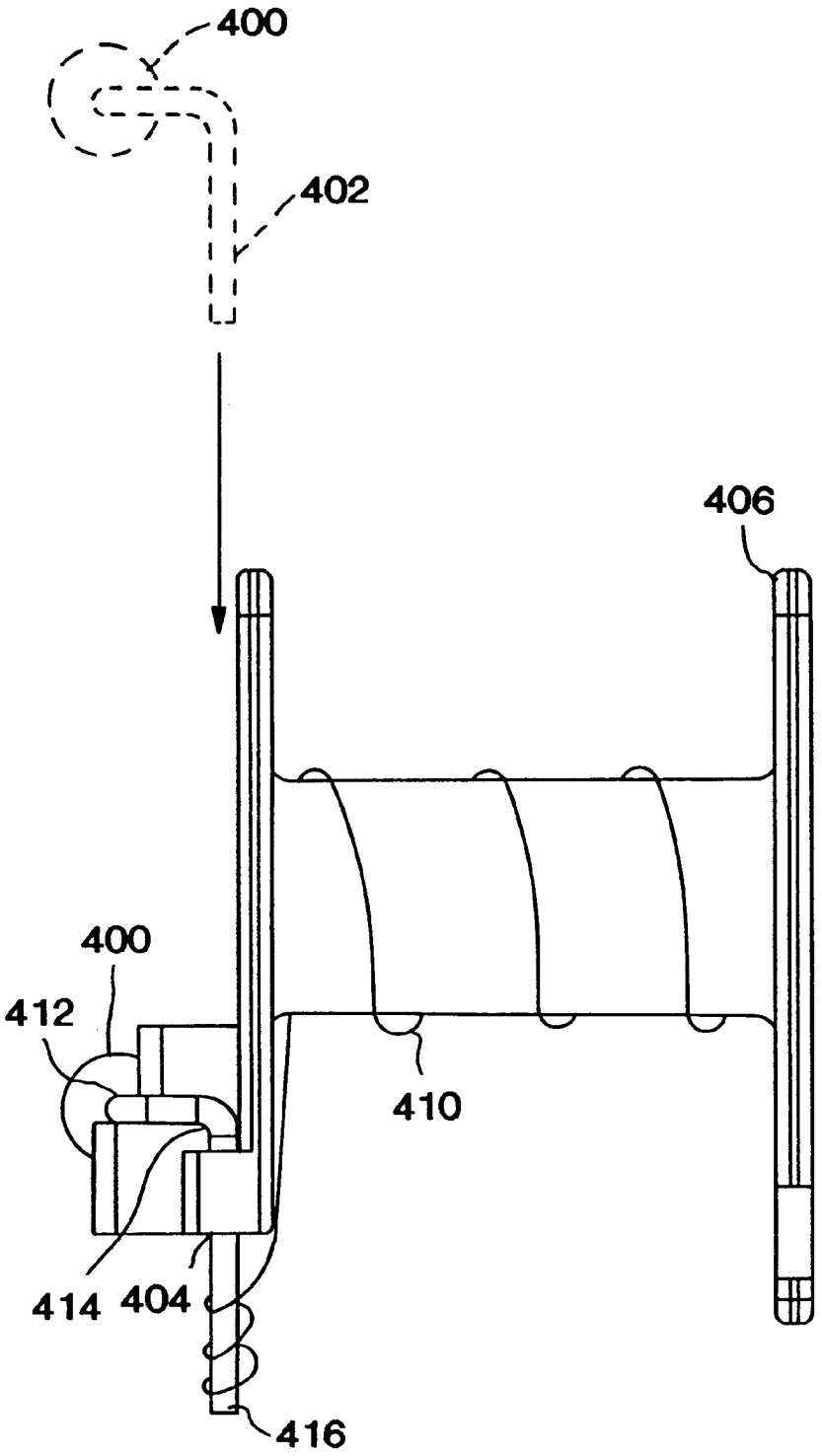
FIG. 28 is a side view of a bobbin showing the formed electrical component of FIG. 27C being installed therein in accordance with the present invention.

Referring to FIG. 28, electrical component 400 is installed into holes or slots 404 formed in bobbin 406. Bobbin 406 includes a winding coil or coil wire 410 wrapped thereabout. Electrical component 400 is preferably formed twice as described above and indicated in FIG. 28. A first form 412 is provided for an insertion stop against bobbin 406, and a second form 414 provides an area 416 for connecting ends of coil wire 410. Component leads 402 are preferably used as a start and finish wrap for coil wire 410. This includes component leads 402 as part of coil wire 410. In preferred embodiments, coil wire 410 is soldered or welded to electrical component 400 to secure electrical component 400 in place. Coil wire 410 may be connected by crimping or other reversible connection technique so as to provide removal and replacement of electrical component 400 as needed. Prior to winding coil wire 410 in bobbin 406, component 400 is installed as shown and a first end portion of coil wire 410 is attached to one component lead 402. Coil wire 410 is wrapped while attached to component lead 402. After coil wire 410 is wrapped around bobbin 406, a second end portion of coil wire is attached to the other component lead 402. In this way, component leads 402 function as part of coil wire 410.

Figure 29:
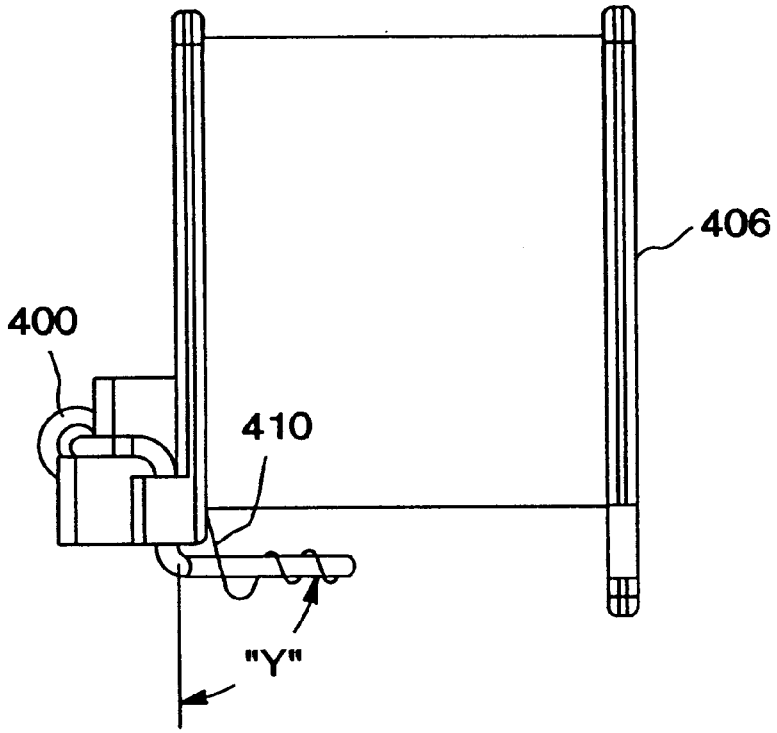
FIG. 29 is a side view of the bobbin of FIG. 28 showing a coil wire wrapped around leads of the electrical component and showing the leads formed to be substantially parallel to a base when fully assembled in accordance with the present invention.
Figure 30:
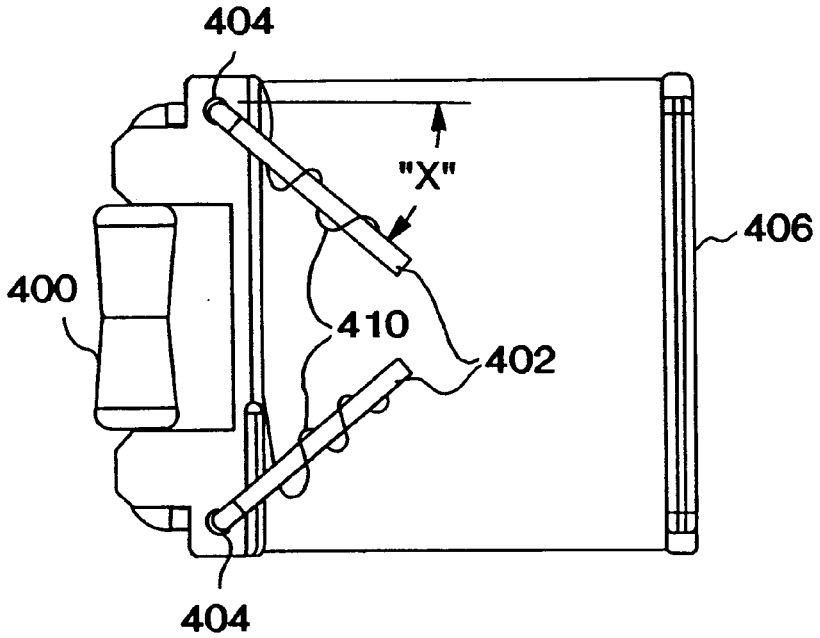
FIG. 30 is a bottom view of the bobbin of FIG. 29 showing the leads formed to be turned inward in accordance with the present invention.

Referring to FIGS. 29 and 30, after coil wire 410 is wound about bobbin 406, electrical component end portions are preferably reformed to relieve stress in coil wire 410 during coil winding. Leads 402 are formed by bending leads 402 by angles X and Y. In a preferred embodiment, the bending of leads 402 by angles X and Y is performed in a single step, preferably by employing a forming tool. Angle X is preferably about 45 degrees while angle Y is about 90 degrees. Angles X and Y may be varied to not only provide stress relief but to also provide clearance for proper fit of other components.

Figure 32:
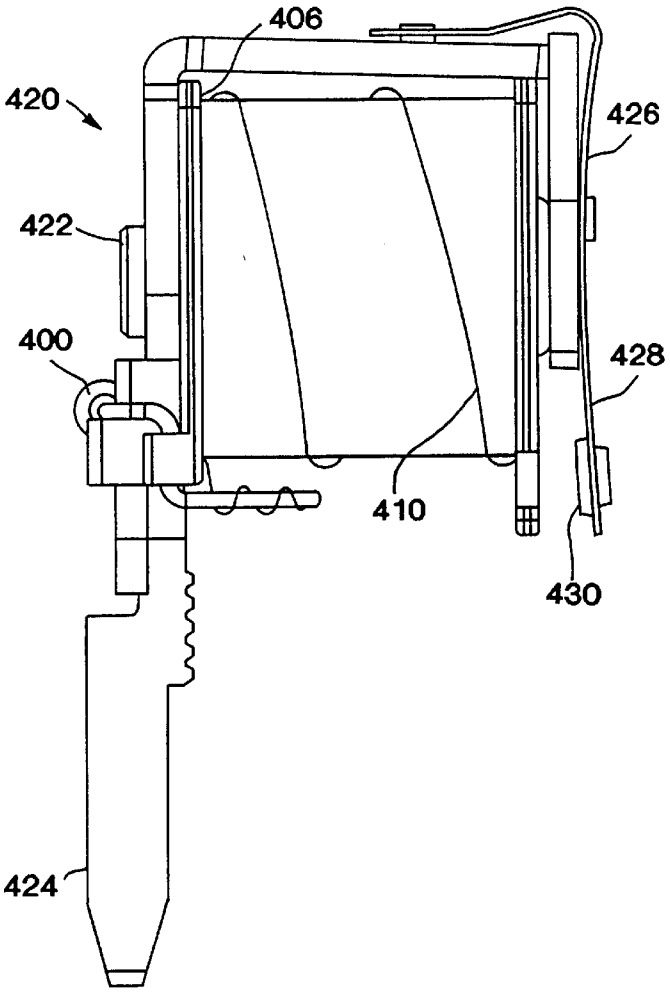
FIG. 32 is a side view of the motor assembly of FIG. 31 in accordance with the present invention.
Figure 31:
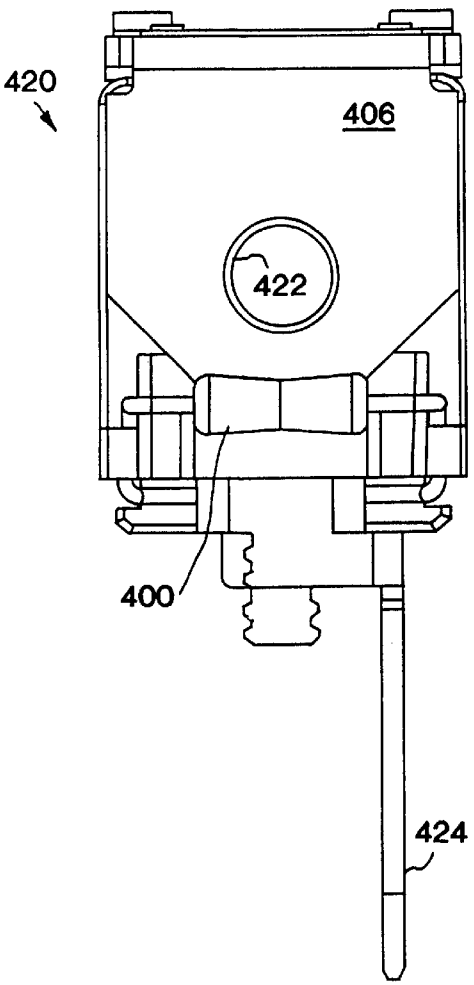
FIG. 31 is a front view of a motor assembly in accordance with the present invention.

Referring to FIGS. 31 and 32, a relay motor assembly 420 includes bobbin 406, electrical component 400, coil wire 410, a core 422, a frame or common terminal 424 and an armature 426, a movable contact arm 428 and a movable contact 430. Core 422 provides for electromagnetic actuation of armature 426 due to an electromagnetic force developed by coil wire 410 during energizing. Armature 426 including movable contact arm 428 moves movable contact 430 between stationary contacts as described above. Frame terminal 424 is attached to bobbin 406 by riveting, staking, welding, etc., and provides an external connection to one end of coil wire 410. The structure of motor assembly 420 is as described above and may be varied accordingly.

Figure 35:
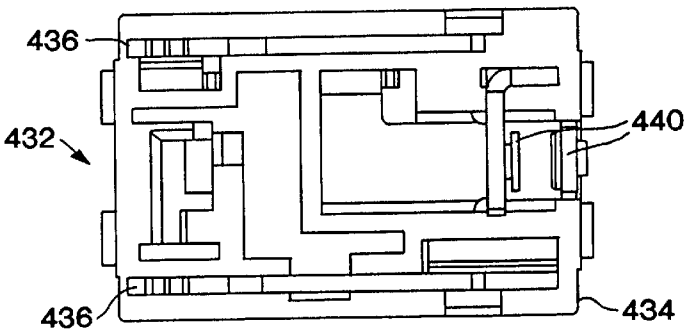
FIG. 35 is a top view of the base assembly of FIG. 34 in accordance with the present invention.
Figure 34:
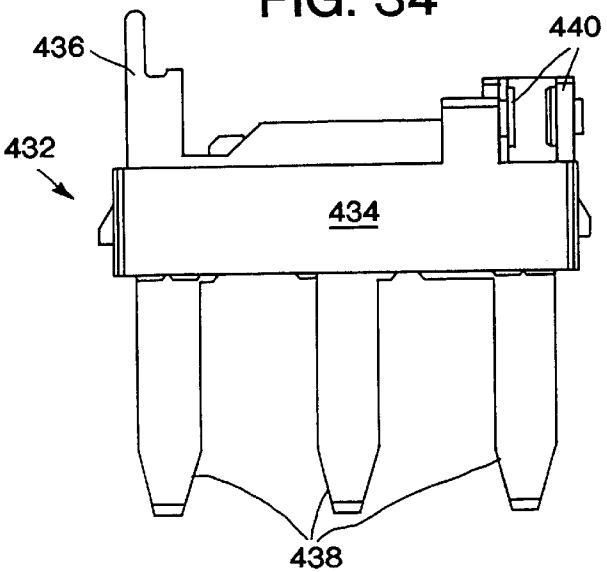
FIG. 34 is a side view of the base assembly of FIG. 33 in accordance with the present invention.
Figure 33:
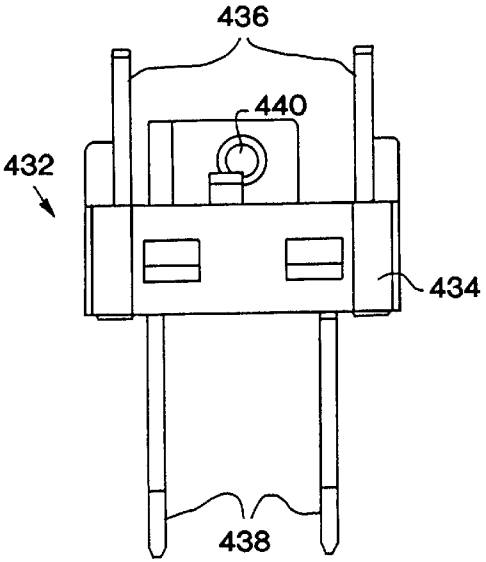
FIG. 33 is a front view of a base assembly in accordance with the present invention.

Referring to FIGS. 33, 34 and 35, a base assembly 432 is shown for an electromagnetic relay in accordance with the present invention. Base assembly 432 includes a base 434, coil terminals 436, contact terminals 438 and contacts 440. Coil terminals 436 are configured and dimensioned to receive a portion of leads 402 of electrical component 400 as described above. Base 434 defines a bottom plane of the relay. Contact terminals 436 provide external connection points in conjunction with contacts 440. Armature 426 including movable contact arm 428 moves movable contact 430 between contacts 440 during operation. The structure of base assembly 432 is as described above and may be varied accordingly.

Figure 36:
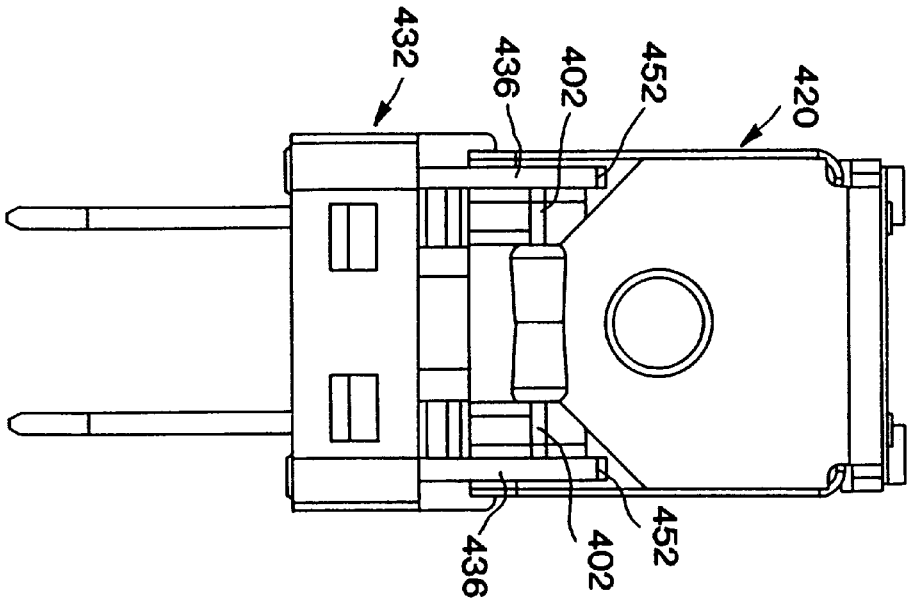
FIG. 36 is a front view of an electromagnetic relay assembly in accordance with the present invention.
Figure 37:
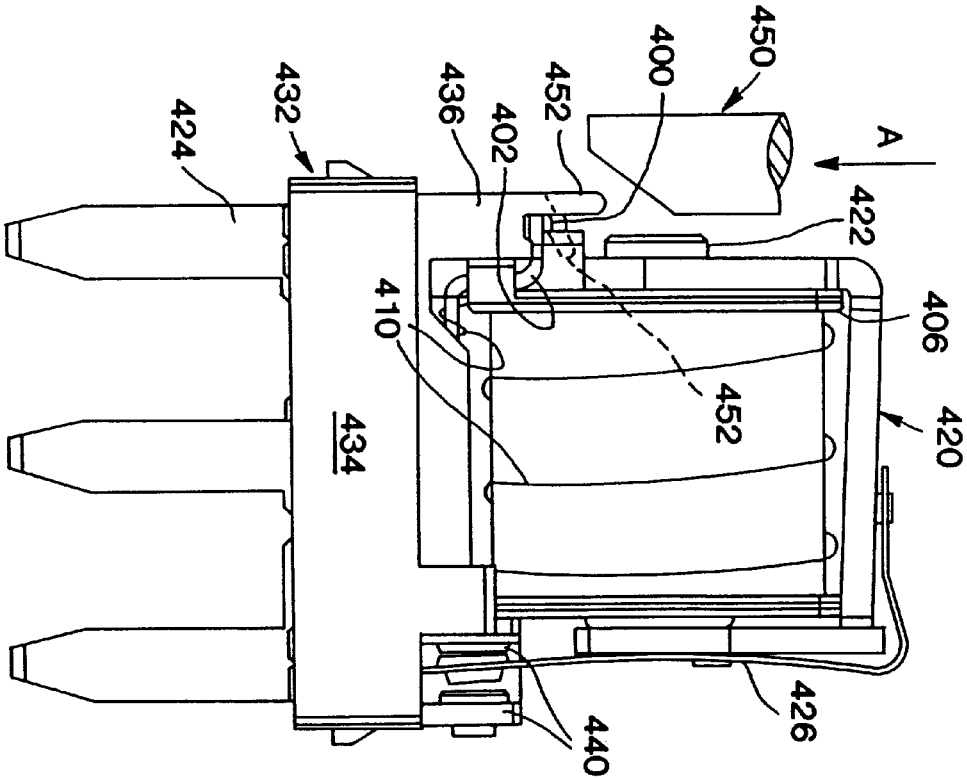
FIG. 37 is a side view of the electromagnetic relay of FIG. 36 showing a forming tool for crimping coil terminals in accordance with the present invention.

Referring to FIGS. 36 and 37, relay motor assembly 420 is installed into base assembly 432, preferably by loading motor assembly 420 downwardly in the direction of arrow "A". Coil terminals 436 are configured to receive a portion of leads 402 therein. Coil terminals 436 may include one or more of the terminal leg configurations shown in FIG. 9–26. It is preferable to have an electromagnetic relay assembled from a common direction such as in the direction of arrow "A". In this way, manufacturing is simplified and costs are reduced. Coil terminals 436 may be used to provide guidance and proper alignment to motor assembly 420 during assembly. Coil terminals 436 are preferably adapted to permit a forming tool 450 to be introduced in the direction of arrow "A" to provide crimping of terminal leg(s) 452. A crimped terminal leg 452 is shown in phantom lines in FIG. 37. In alternate embodiments, leads 402 may be soldered or welded to provide additional strength and conductivity to the connection.

Having described preferred embodiments of a novel structure and method for connection of an electrical component to an electromagnetic relay (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An electromagnetic relay comprising:

a base defining a bottom plane;

a motor assembly mounted on the base, the motor assembly including a bobbin, a core with a winding wound about the core and an electrical component having leads attached to ends of the winding, said leads being routed through a portion of the bobbin and being configured to relieve stress in the winding at coupling portions to the winding;

an armature supported to be movable about a predetermined point for movement imparted by the motor assembly between two contact operating positions such that at least one contact assembly is actuated by the armature between the two contact positions to selectively provide one of an open and closed circuit; and at least one terminal member mounted on the base having a first end for electrically connecting an end of the winding with a source of energy, and a second end including at least one depending leg to define a slot for receiving at least one lead of the electrical component.

2. The electromagnetic relay as recited in claim 1, wherein the electrical component is a diode.

3. The electromagnetic relay as recited in claim 1, wherein the electrical component is a resistor.

4. The electromagnetic relay as recited in claim 1, wherein the leads of the electrical component each include an end portion extending beyond the base, the end portions being formed to be disposed substantially parallel to the bottom plane.

5. The electromagnetic relay as recited in claim 4, wherein the end portions are formed to have ends of the end portions turned inwardly toward each other.

6. The electromagnetic relay as recited in claim 1, wherein the at least one depending leg is configured to be mechanically crimped to secure at least one lead of the electrical component within a portion of the slot.

7. The electromagnetic relay as recited in claim 1, wherein the at least one leg has a notch in an inner surface for receiving a lead of the electrical component.

8. The electromagnetic relay as recited in claim 1, wherein the slot includes a protrusion on an inner surface for capturing a lead of the electrical component in the slot.

9. The electromagnetic relay as recited in claim 1, wherein the electrical component leads are attached to the ends of the winding by one of a solder joint and a weld.

10. The electromagnetic relay as recited in claim 1, wherein the leads of the electrical component include at least one bend of about 90 degrees.

11. The electromagnetic relay as recited in claim 1, wherein the leads of the electrical component include at least one bend of about 45 degrees.

* * * * *